US006273982B1

(12) United States Patent
Semmler

(10) Patent No.: US 6,273,982 B1
(45) Date of Patent: Aug. 14, 2001

(54) MANUAL DEVICE FOR TRANSFERRING A FILM FROM A CARRIER TAPE TO A SUBSTRATE

(75) Inventor: Georg Semmler, Wiesbaden (DE)

(73) Assignee: BIC Deutschland GmbH & Co., Liederbach (DE)

( * ) Notice: Subject to any disclaimer, the term of this patent is extended or adjusted under 35 U.S.C. 154(b) by 0 days.

(21) Appl. No.: 09/331,819

(22) PCT Filed: Nov. 25, 1997

(86) PCT No.: PCT/EP97/06576

§ 371 Date: Jun. 24, 1999

§ 102(e) Date: Jun. 24, 1999

(87) PCT Pub. No.: WO98/32682

PCT Pub. Date: Jul. 30, 1998

(30) Foreign Application Priority Data

Jan. 23, 1997 (DE) ..... 197 02 345

(51) Int. Cl.[7] ..... B32B 31/00

(52) U.S. Cl. ..... 156/238; 156/540; 156/577; 156/579; 118/76; 118/257; 242/160.4; 242/171; 242/588.6

(58) Field of Search ..... 156/238, 523, 156/527, 540, 574, 577, 579; 118/76, 200, 257; 225/46; 242/160.2, 160.4, 170, 171, 588.2, 588.3, 588.6, 588

(56) References Cited

U.S. PATENT DOCUMENTS 5,346,580 * 9/1994 Elges et al. ..... 156/540
5,430,904 * 7/1995 Ono et al. ..... 156/577 X
6,000,455 * 12/1999 Semmler ..... 156/540

FOREIGN PATENT DOCUMENTS

3644946 C2 5/1988 (DE) .
37 36 357 C2 11/1988 (DE) .
42 20 712 A1 1/1994 (DE) .
08059055 A 3/1996 (JP) .
08175738 A 7/1996 (JP) .

* cited by examiner

*Primary Examiner*—Mark A. Osele

(57) ABSTRACT

A hand-operated appliance (1) for transferring a film from a carrier tape (7) to a substrate is proposed, this having a casing (2), an interchangeable cassette (3) which can be inserted in the casing (2), a supply spool (4) for a carrier tape (7) coated with a film and a wind-up spool (5) for taking up the carrier tape (7) separated from the film, both spools being held in the interchangeable cassette (3), an applicator device (6) which deflects the carrier tape (7), projects out of the casing (2) and presents the side of the carrier tape (7) which is coated with the film to the substrate, and a drive connection (8) provided with a slip coupling (9) between the supply spool (4) and the wind-up spool (5) which, as the supply spool (4) is driven by drawing off the carrier tape (7), drives the wind-up spool (5) at a rotational speed which is such that the carrier tape (7) always remains tensioned. In order to enable the spools (4, 5) to be easily replaced, while being easy and inexpensive to produce, the hand-operated appliance according to the invention is characterised in that the applicator device (6) consists of an applicator strip (10) located on the casing (2) and of a tape guide device (11) located on the interchangeable cassette (3) for the carrier tape (7), wherein the tape guide device (11) is formed such that it holds a part of the carrier tape (7) ready as a loop into which the applicator strip (10) enters when the interchangeable cassette (3) is loaded into the casing (2).

27 Claims, 5 Drawing Sheets

11c
11b
11b
11a
11d
11a
7
21
19
17
4b
4a
a
15
15
8,9
3
5b
20
5a
18
22
16
d1
d2

MANUAL DEVICE FOR TRANSFERRING A FILM FROM A CARRIER TAPE TO A SUBSTRATE

The invention relates to a hand-operated appliance for transferring a film from a carrier tape to a substrate according to the preamble of claim 1.

Hand-operated appliances of the above-mentioned type are primarily used in offices to apply a coloured, opaque or adhesive film from a carrier tape to a substrate such as paper, for example. Hand-operated appliances of this kind enable the user to apply the film very neatly and to a localised point.

DE 36 44 946 C2 discloses a hand-operated appliance for applying an adhesive film to a substrate. The hand-operated appliance consists of a casing containing a supply spool for a carrier tape coated with an adhesive film, a wind-up spool for taking up the carrier tape separated from the adhesive film, a tape guide device and an applicator device which deflects the carrier tape, can spring elastically outwards, projects out of the casing and presents the side of the carrier tape which is coated with the adhesive film to the substrate. A drive connection provided with a slip coupling is disposed between the supply spool and the wind-up spool and, as the supply spool is driven by drawing off the carrier tape, drives the wind-up spool at a rotational speed which is such that the carrier tape always remains tensioned. In order to simplify the entire refilling handling process for the user when changing the tape, the supply spool and the wind-up spool, as well as the applicator device and the tape guide device, are accommodated in an interchangeable cassette. In addition, the drive connection, which is provided entirely within the casing, comprises a so-called input and a so-called output driving pin for mounting the two spools, so that the interchangeable cassette can be positioned accurately in the casing.

The spool changing operation is simplified even further for the user in DE 37 36 357 C2. In the region of the applicator device an additional support-centring pin at the casing and a corresponding holding fixture at the interchangeable cassette ensure that the latter is correctly positioned, and a holder is also provided as a positive locking element to prevent the interchangeable cassette from turning about the support-centring pin.

The applicants' German patent application DE 42 20 712 C2 discloses a hand-operated appliance of a particularly simple and small design. The hand-operated appliance for transferring a film from a carrier tape to a substrate, with a casing, in which a supply spool and a wind-up spool for the carrier tape are rotatably mounted, and an applicator device disposed at the casing, is distinguished by a special type of drive connection between the spools. The drive connection with a slip coupling is formed as a friction drive directly between the two spools.

Starting out from the above prior art, the object of the invention is to provide a hand-operated appliance of the type initially mentioned which enables the spools to be easily replaced while being easy and inexpensive to produce.

This object is achieved by the features of claim 1. The interchangeable cassette can easily be loaded and the carrier tape tensioned on account of the two-part construction of the applicator device, with the applicator strip being located on the casing and the tape guide device on the interchangeable cassette, and the tape guide device being formed such that it holds a part of the carrier tape ready as a loop into which the applicator strip enters when the interchangeable cassette is loaded into the casing. As the interchangeable cassette is formed in a relatively simple manner on account of the construction according to the invention, it can accordingly be produced easily and inexpensively.

In a development of the invention locking means with seats are provided in the casing of the hand-operated appliance which, when the interchangeable cassette is loaded, secure it in a first position in which the tape guide device protrudes with respect to the applicator strip, so that the applicator strip enters into the loop of the carrier tape, and which, after the interchangeable cassete has been pushed back, secure it in an end position in which the tape guide device is pushed back with respect to the applicator strip, so that the carrier tape of the loop runs over the applicator strip.

Further configurations and developments are the subject of subsequent claims.

A preferred embodiment of the invention is illustrated in detail in the following on the basis of the accompanying drawings, in which.

Figure 1:
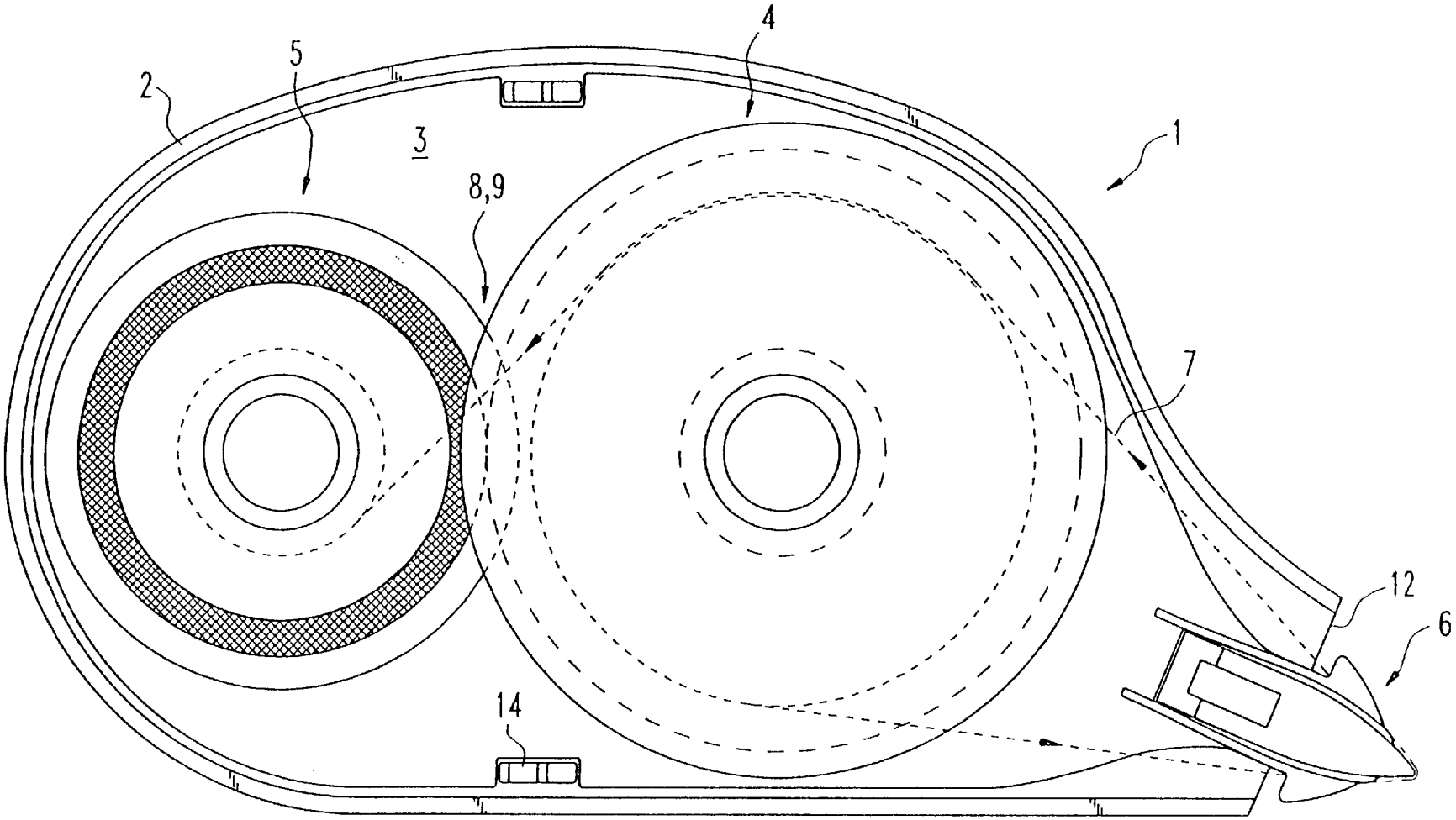
FIG. 1 is a side view of a hand-operated appliance according to the invention with the second casing half having been removed.
Figure 2:
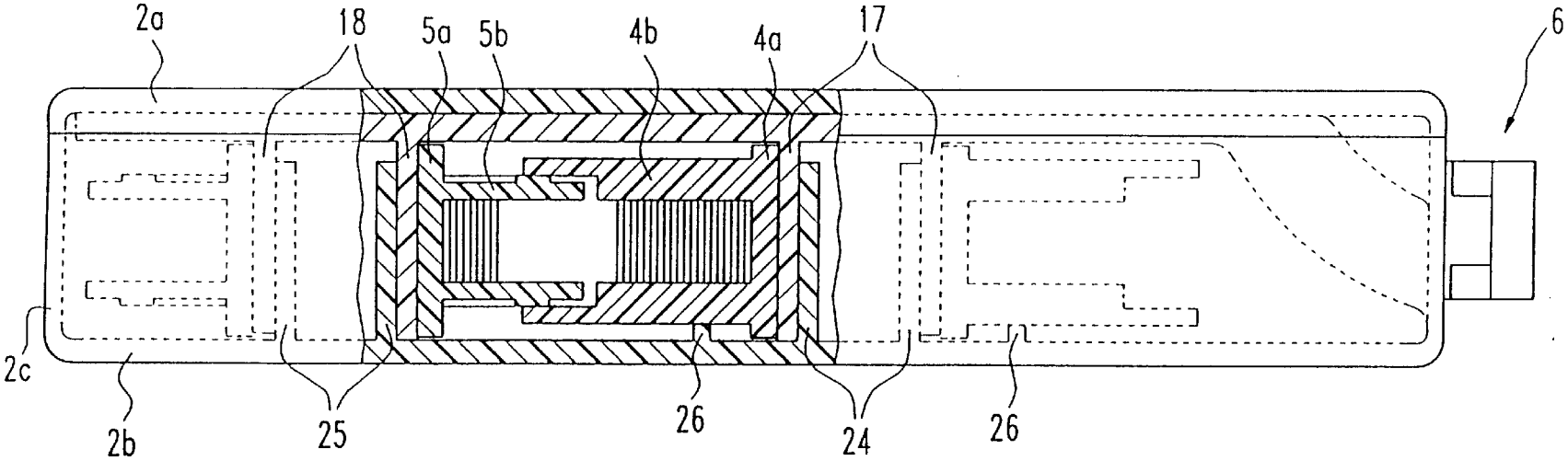
FIG. 2 is a plan view of the hand-operated appliance of FIG. 1.

FIGS. 1 and 2 show a preferred embodiment of a hand-operated appliance according to the invention when ready for use, i.e. Wilt an inserted interchangeable cassette, while FIGS. 3 to 6 each show the individual components of the hand-operated appliance according to the invention which is shown in FIGS. 1 and 2. The process of loading the interchangeable cassette into the casing is illustrated in detail on the basis of FIGS. 7 and 8.

The main components of the hand-operated appliance 1 are a casing 2 of a manageable size, an interchangeable cassette 3, a supply spool 4, which is rotatably mounted in the interchangeable cassette 3, a wind-up spool 5, which is rotatably mounted in the interchangeable cassette 3, an applicator device 6, which projects out of the casing 2 and consists of an applicator strip 10 and a tape guide device 11, a carrier tape 7 and a drive connection 8, which is disposed between the spools 4, 5 and has an integrated slip coupling 9. All the parts of the hand-operated appliance 1 which have been described above and are yet to be described preferably consist of a plastics material and—with the exception of the carrier tape 7—may be produced by injection moulding.

In the side view according to FIG. 1 the casing 2 is in the shape of a drop, which may be rounded or polygonal. The horizontal width of the casing 2 is relatively small, being approximately 20 to 25 mm.

The casing 2 consists of a first casing half 2*a* and a second casing half 2*b*, this not being included in FIG. 1, which can be fastened to the first casing half by clamping and/or interlocking. The surrounding side wall 2*c* of the casing 2 may be moulded both onto the first casing half 2*a* and onto the second casing half 2*b*; the illustrated embodiment shows the side wall 2*c* on the second casing half 2*b*. The bottom front corner of the casing 2 is provided with a through-opening 12, through which the applicator device 6 projects out of the casing 2 when the hand-operated appliance 1 is closed. The through-opening 12 is dimensioned such that slits which form the delivery or feed opening for the carrier tape 7 are provided between the underside and the top side of the applicator device 6 and the side wall 2*c* of the casing 2.

The carrier tape 7 is coated with a coloured, opaque or adhesive film—according to the purpose of the application. The carrier tape 7, which can be drawn off the supply spool 4, is guided around the applicator device 6 and runs back into the casing 2 to the wind-up spool 5. In order to apply the film to a substrate such as paper, for example, the applicator strip 10 of the applicator device 6 is pressed against the substrate, so that the film which is presented to the substrate adheres to the latter.

The supply spool 4 and the wind-up spool 5 are disposed in an interchangeable cassette 3. The interchangeable cassette 3 is substantially a plate which has a drop-shaped contour like the casing 2 and which can be loaded or inserted into the first casing half 2*a*. For the purpose of accurate positioning and as a loading aid for the interchangeable cassette 3, a plurality of locking means 14 in the form of pins or studs are located on the first casing half 2*a*, these engaging in corresponding locking means 15 in the form of recesses or openings in the plate 3. The locking means 14, 15 may be disposed at the edge of or within the plate 3. The loading operation and the special form of the locking means 14, 15 are described in greater detail on the basis of FIGS. 6 to 8.

A bearing sleeve 17 for the supply spool 4 and a bearing sleeve 18 for the wind-up spool 5 are moulded onto the plate 3 along a line 16 extending approximately through the centre of the casing 2 and approximately parallel to the bottom edge of the latter. The outside diameter of the bearing sleeves 17, 18 is in this case slightly smaller than the respective hub parts 4*a*, 5*a* of the two corresponding spools 4, 5, so that the spools 4, 5 are rotatably mounted on the stationary bearing sleeves 17, 18. In the embodiment described here the supply spool 4 is disposed before the wind-up spool 5 in relation to the applicator device 6.

The drive connection 8 and the slip coupling 9 between the two spools 4, 5 correspond to the drive connection and the slip coupling disclosed in the applicants' publication DE 42 20 712 C2. Lateral spool walls 4*b*, 5*b*, between which the carrier tape 7 is wound or wound up, extend from the hub parts 4*a*, 5*a* of the spools 4, 5. The drive connection 8 and the slip coupling 9 are formed by at least one pair of friction surfaces 19, 20 which are directly in engagement with one another and which in the present embodiment are formed at opposite inner and outer faces of the spool walls 4*b*, 5*b*. The sum of the distances $d_1/2$, $d_2/2$ of the friction surfaces 19, 20 from the rotational axes of the respective spools 4, 5 is greater than the centre distance a between the two spools 4, 5, so that the friction surfaces 19, 20 of the spool walls 4*b*, 5*b* overlap. In this configuration the outer spacing of the spool walls 5*b* of the wind-up spool 5 is adapted to the inner spacing of the spool walls 4*b* of the supply spool 4, so that the wind-up spool 5 fits with its spool walls 5*b* between the spool walls 4*b* of the supply spool 4, as shown in the plan view of FIG. 2. In order nevertheless to guarantee the lateral guidance of the carrier tape 7 on the supply spool 4, the supply spool walls 4*b* may be thickened inwards to the guide width in the winding region.

When the rotational drive between the spools 4, 5 is based solely on frictional action between preferably plane friction surfaces 19, 20, a compressive stress between the friction surfaces 19, 20 is required to produce the friction. This can be achieved by slightly overdimensioning or underdimensioning the outer spacing between the wind-up spool walls 5*b* and the inner spacing between the supply spool walls 4*b*, with the initial stress being based on the elasticity of the material with which associated spool walls are pressed together. The two associated spool walls 4*b* and 5*b* are preferably provided with friction surfaces 19 and 20 as described above, so that two friction surface pairs are present.

The drive connection 8 between the spools 4 and 5 must be designed such that, taking account of the winding diameters 21 and 22 effective at the time, the wind-up spool 5 is driven at such a speed that the carrier tape section to be wound up is always slightly tensioned. The slip coupling 9 comes into operation above a certain driving torque active in the drive connection 8, so that, although the wind-up spool 5 is driven faster, it only rotates at a speed which corresponds to the speed of movement of the carrier tape 7, so as to prevent the carrier tape 7 from tearing.

The drive connection 8 must have a transmission ratio for driving the wind-up spool 5 faster, according to the spool base size. In this embodiment this is achieved by making the average diameter $d_1$ of the annular friction surface 19 at the supply spool 4 greater than the average diameter $d_2$ of the annular friction surface 20 at the wind-up spool 5.

It is equally possible to create or replace the frictional action between the spool walls 4*b*, 5*b* by elevations and depressions in the form of teeth with associated tooth spaces, the tooth engagement of which can be bridged in order to form the slip coupling 9. The applicants' publication DE 42 20 712 C2 is referred to at this point for a more precise description of this alternative for the drive connection 8.

As the drive connection 8 and the slip coupling 9 are formed as one part at the spools 4, 5, no additional parts are required. Moreover, the use of small and simple components permits a simple and inexpensive production process. The arrangement of the two spools 4, 5 in an interchangeable cassette 3 makes it easier for the user to change the spools, and, due to the construction of the drive connection 8 and the slip coupling 9 described above, the user does not need to ensure that the spools 4, 5 are properly arranged when carrying out a spool change, as these are located together with the drive connection 8 and the slip coupling 9 in an exact position in relation to one another in the interchangeable cassette 3.

As already mentioned above, in order to apply the film to a substrate, the carrier tape 7 is guided around the applicator device 6 which projects out of the casing 2 and is pressed against the substrate. According to the invention this applicator device 6 is of a two-part construction. It consists of a tape guide device 11 located on the interchangeable cassette 3 and of an applicator strip 10 located on the first casing half 2*a*.

Figure 3:
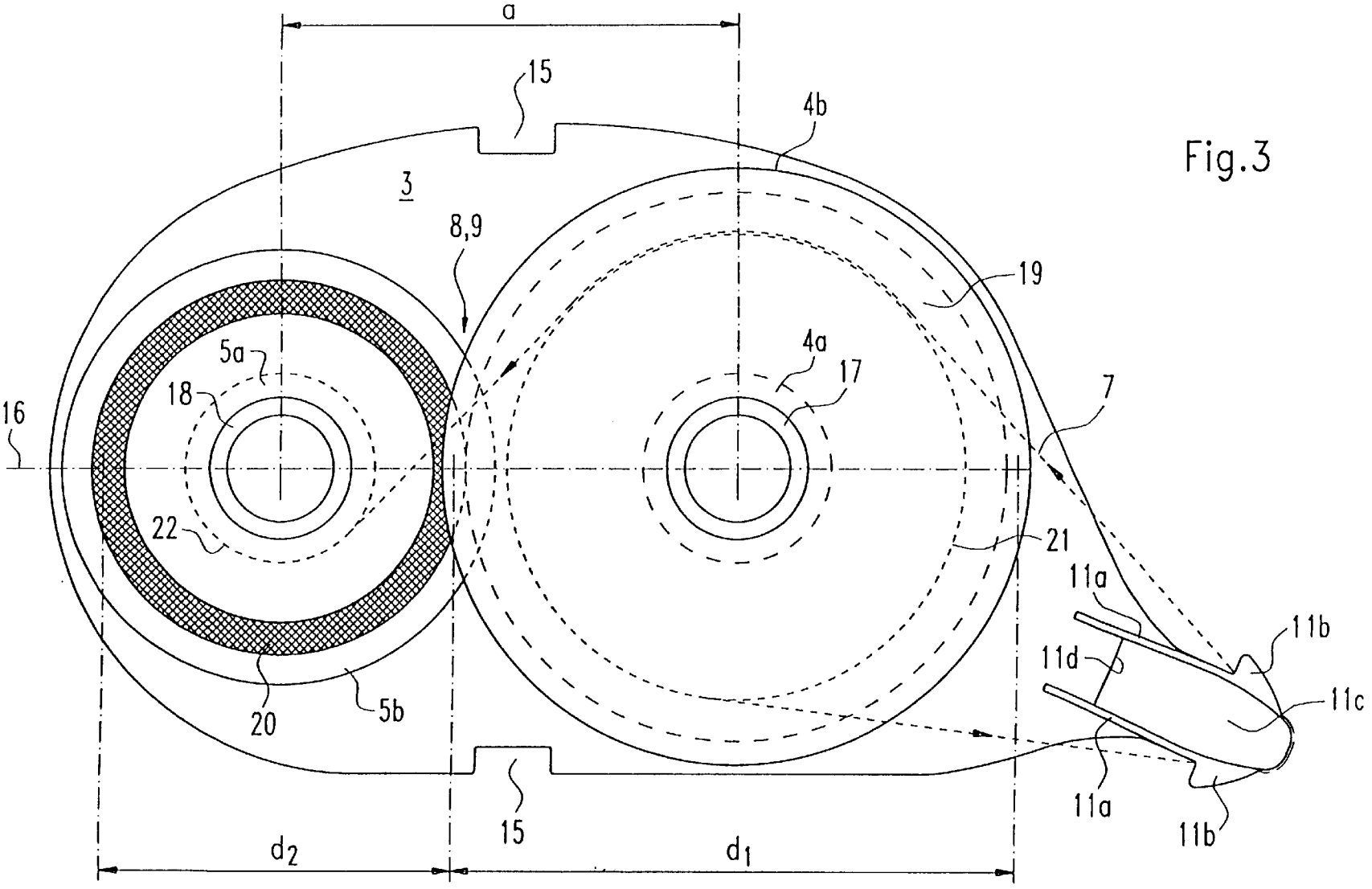
FIG. 3 is a side view of the interchangeable cassette of the hand-operated appliance of FIG. 1.

The tape guide device 11 at the interchangeable cassette 3 consists substantially of two guides 11*a* projecting out of the casing 2 and extending approximately parallel to one another and, at least in the front region, parallel to the carrier tape 7. In their front region the guides 11*a* each have two lateral boundary walls 11*b*, between which the carrier tape 7 is passed. The spacing between the lateral boundary walls 11*b* of a guide 11*a* is slightly greater than the width of the carrier tape 7. A clearance 11*c* is provided between the two guides 11*a*, which clearance is bounded by a contact edge 11*d* towards the plate 3 and is open towards the front end. As can be seen in FIG. 3, the carrier tape 7 is guided around the front ends of the two-guides 11*a* in the form of a loop.

Figure 4:
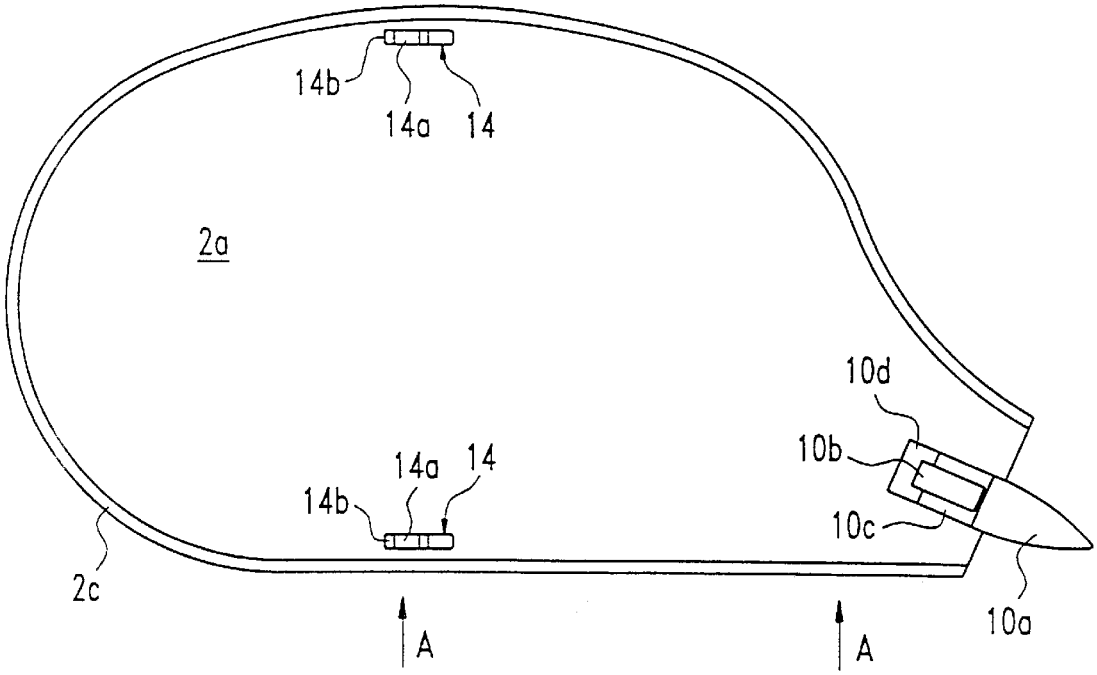
FIG. 4 is a side view of the first casing part of the hand-operated appliance of FIG. 1.
Figure 5:
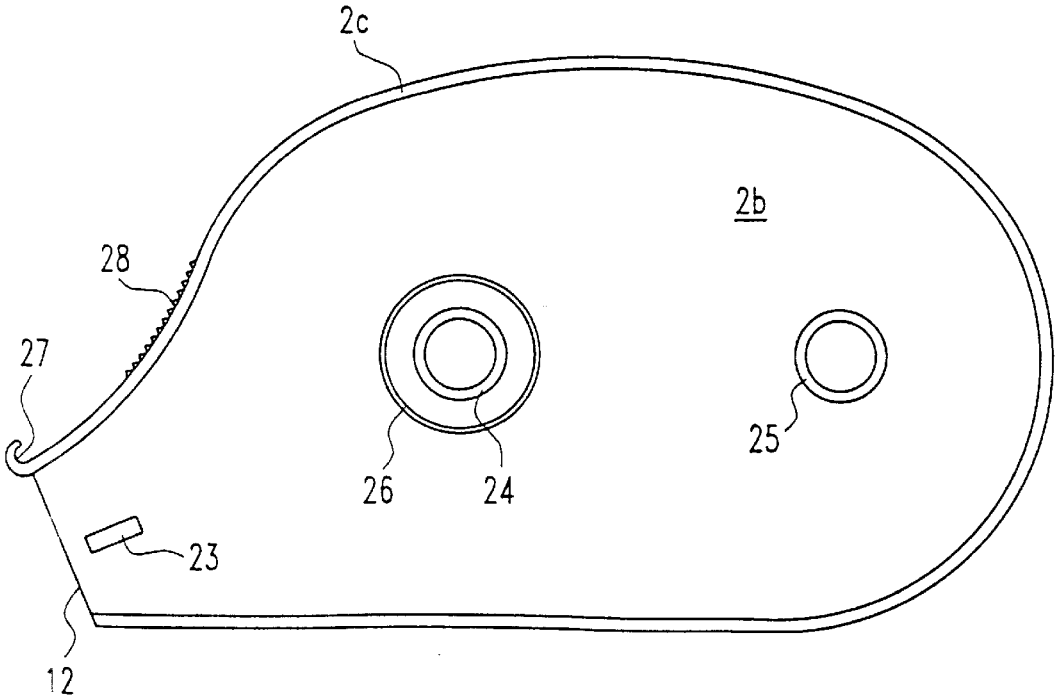
FIG. 5 is a side view of the second casing half of the hand-operated appliance of FIG. 1.
Figure 6:
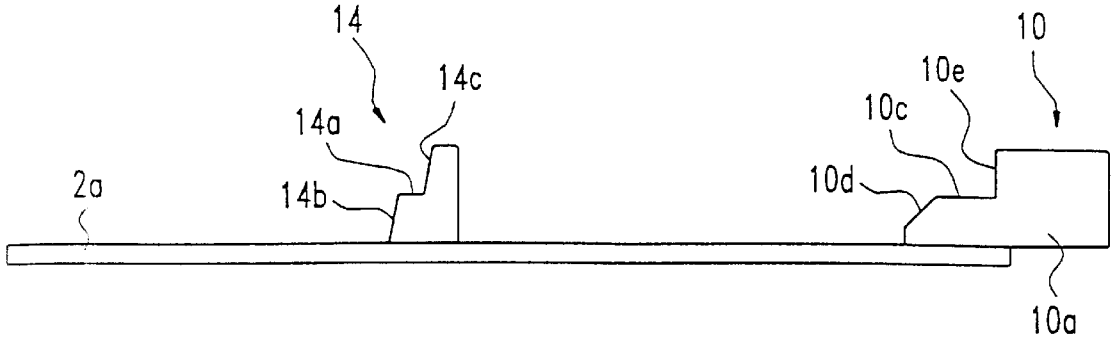
FIG. 6 shows the first casing half of FIG. 1 in a view A from FIG. 4.
Figure 7:
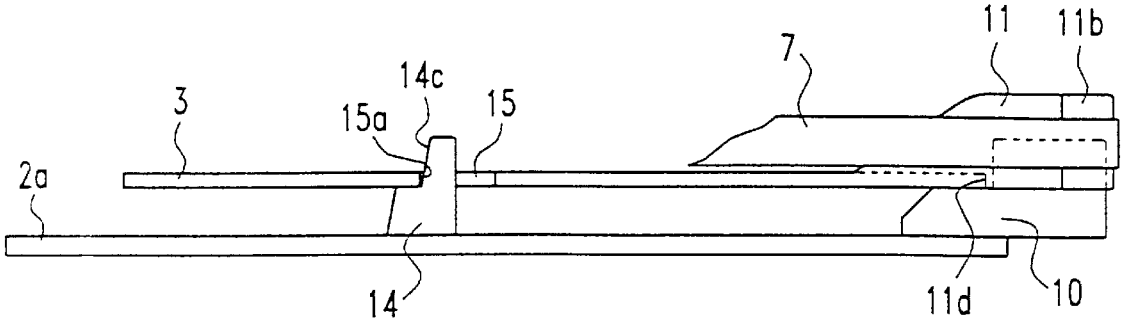
FIG. 7 shows the first casing half of FIG. 6 with the interchangeable cassette in a first position.
Figure 8:
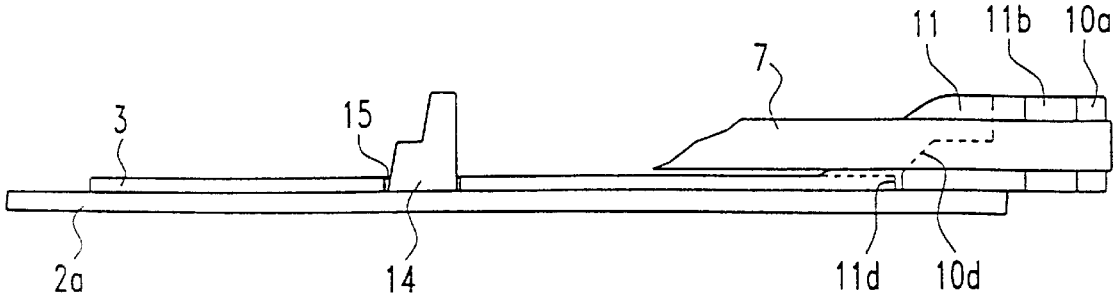
FIG. 8 shows the first casing half of FIG. 6 with the interchangeable cassette in a second position.

FIGS. 6–8 show the first casing half 2*a* in a side view and in a view A from FIG. 6. The applicator strip 10 is preferably integral with the first casing half 2*a* and in the form of a wedge 10*a* in the front region. The tip of this preferably rigid wedge 10*a* is advantageously rounded. The rear part of the applicator strip 10 is stepped with respect to the horizontal width of the wedge 10*a* and forms a seat 10*c*. The applicator strip 10 leads downwards from this seat 10*c* at the end in the form of a slope 10*d* to the level of the plate 3. As shown in FIG. 4, a holding opening 10*b* is provided in the applicator strip 10 in the rear region 10*c*, 10*d* to accommodate a centering device 23 provided on the second casing half 2*b* (FIG. 5).

The locking means 14 on the first casing half 2*a* are also stepped in a manner similar to that of the applicator strip 10. As shown in FIG. 6, the locking means 14 also comprise a seat 14*a* extending away from the applicator strip 10 in the rear region and lying approximately at the same level above the plate 3 as the seat 10*c* of the applicator strip 10. A slope 14*b* is likewise provided at the rear end adjacent to the seat 14*a*.

The loading of the interchangeable cassette 3 is described in the following on the basis of both FIGS. 7 and 8. The interchangeable cassette 3 is firstly placed on the seats 10*c* and 14*a* of the applicator strip 10 and the locking means 14. The contact edge 11*d* of the tape guide device 11 and the contact edge 15*a* of the opening are positioned at the rear edges 10*e*, 14*c* of the front regions of the applicator strip 10 and locking means 14. The rear edges 10*e*, 14*c* may advantageously be bevelled to make it easier to load the interchangeable cassette 3 into this first position.

As shown in FIG. 7, in this first position of the interchangeable cassette 3 the applicator strip 10 enters with its wedge 10*a* into the loop of the carrier tape 7, which loop is guided tautly around the tape guide device 11. The interchangeable cassette 3 is then pushed back until the contact edges 11*d* and 15*a* slide down over the slopes 10*d* and 14*b* and the plate 3 is lying on the casing half 2*a*.

This end position is shown in FIG. 8. In this position the wedge 10*a* of the applicator strip 10 projects through the two webs 11*a* of the tape guide device 11 out of the casing 2, while the carrier tape 7 is guided tautly around the tip of the wedge 10*a*. As before, the lateral boundary walls 11*b* at the webs 11*a* of the tape guide device 11 guarantee the lateral position of the carrier tape 7.

The two-part applicator device 6 according to the invention which is described above has the following advantage: When the interchangeable cassette 3 is loaded into the casing 2 the applicator strip 10 moulded on the first casing half 2*a* serves both as a holding and positioning device for the tape guide device 11 moulded on the interchangeable cassette 3 and to tension the carrier tape 7. This means that, apart from the applicator device 6, all that is required are the locking means 14, which are formed relatively simply, on the casing 2, and the interchangeable cassette 3 and carrier tape 7 can still be easily inserted into the casing 2 so as to take up an accurate position. Just a simple tape guide device 11 is moulded onto the actual interchangeable cassette 3 instead of a complex applicator device 6 as in the case of conventional hand-operated appliances. The interchangeable cassette 3 can therefore be produced easily and inexpensively, while saving materials.

As shown in FIG. 5, for the purpose of securely holding the two spools 4, 5 in the casing 2, the second casing half 2*b* comprises two bearing sleeves or pins 24 and 25 for holding the bearing sleeves 17 and 18 moulded onto the interchangeable cassette 3. The outside diameter of the bearing sleeves or pins 24, 25 corresponds approximately to the inside diameter of the bearing sleeves 17, 18, and a slight clamping action can preferably be achieved.

In addition, a support ring 26 of a greater diameter than the bearing sleeve 24 is located concentrically with the latter on the second casing half 2*b*. The diameter and the height of the support ring 26 are determined such that the spool wall 4*b* of the supply spool 4 lies on this support ring 26 in its inner region (within the friction surface 19).

The second casing part 2*b* also comprises a fastening device 27 above the through-opening 12 on the outer face of the side wall 2*c* for a protective cap (not shown). The protective cap can be turned down over the applicator device 6 projecting out of the through-opening 12, so that the applicator device 6 and the carrier tape 7 guided around the latter are protected when the hand-operated appliance 1 is not in use.

Fluting 28 is also provided on the outer face of the side wall 2*c* in the region above the through-opening 12. The fluting 28 serves as a rest for the user's index finger, so that the hand-operated appliance 1 can be reliably controlled by the user in the latter's hand.

In order to prevent looping of the carrier tape 7 if the hand-operated appliance 1 is used incorrectly, a return stop (not shown) may preferably be associated with the wind-up spool 5. The return stop may be formed, for example, by a stop pawl gear, consisting of a toothed ring which is disposed at the circumferential edge of one of the wind-up spool walls 5*b* and which co-operates with a pawl arm. The pawl arm extends approximately in a tangential direction to the toothed ring and is acted upon by a spring force towards the toothed ring such that the pawl arm runs over the toothed ring in the wind-up direction and prevents reverse rotation of the wind-up spool 5 in the opposite direction of rotation by engaging with the toothed ring.

What is claimed is:

1. Hand-operated appliance for transferring a film from a carrier tape to a substrate, said appliance comprising:

a casing;

an interchangeable cassette configured for insertion into said casing;

a supply spool for a carrier tape coated with a film and a wind-up spool for taking up the carrier tape separated from the film, said supply spool and said wind-up spool being carried by said interchangeable cassette;

an applicator device projecting out of the casing, deflecting the carrier tape, and presenting the side of the carrier tape coated with the film to a substrate; and a drive connection positioned in said interchangeable cassette between said supply spool and said wind-up spool and driving said wind-up spool at a rotational speed sufficient to keep the carrier tape tensioned as said supply spool is driven by drawing off the carrier tape;

wherein:

said applicator device includes an applicator strip located on said casing and a tape guide device located on said interchangeable cassette and formed to hold a part of the carrier tape ready as a loop into which said applicator strip enters when said interchangeable cassette is inserted into said casing;

a seat is provided on said applicator strip configured to hold said interchangeable cassette in a first position in said casing from which said interchangeable cassette is movable into an end position in said casing;

in said first position said tape guide device protrudes with respect to said applicator strip such that said applicator strip enters the carrier tape loop; and in said end position said interchangeable cassette is pushed back from said applicator strip.

2. Hand-operated appliance according to claim 1, further comprising locking means provided in said casing and configured to secure said interchangeable cassette in said end position in which said tape guide device is pushed back with respect to said applicator strip such that the carrier tape of the loop runs over said applicator strip.

3. Hand-operated appliance according to claim 2, wherein seats are formed on said locking means configured to hold said interchangeable cassette in said first position.

4. Hand-operated appliance according to claim 3, wherein said locking means further comprise slopes configured to assist in loading said interchangeable cassette into said casing and into said end position.

5. Hand-operated appliance according to claim 3, wherein openings or recesses in which said locking means of said casing engage are formed in said interchangeable cassette.

6. Hand-operated appliance according to claim 2, wherein:

said casing comprises a first casing half and a second casing half;

a side wall of said casing is molded onto one of said casing halves; and said applicator strip and said locking means are molded onto said first casing half.

7. Hand-operated appliance according to claim 6, wherein said applicator strip is molded onto said casing as a rigid component.

8. Hand-operated appliance according to claim 1, wherein said applicator strip further comprises slopes configured to assist in loading said interchangeable cassette into said casing and into said end position.

9. Hand-operated appliance according to claim 1, wherein said tape guide device comprises a clearance for accommodating said applicator strip.

10. Hand-operated appliance according to claim 1, wherein said interchangeable cassette is formed as a plate on which two bearing sleeves for said spools are molded.

11. Hand-operated appliance according to claim 1, wherein:

said drive connection includes a slip coupling; and said drive connection and said slip coupling are formed by direct friction contact between said spool bodies.

12. A hand-operated appliance for transferring a film from a carrier tape to a substrate, said appliance comprising:

a casing including an applicator strip; and an interchangeable cassette including a supply spool carrying a carrier tape coated with a film, a wind-up spool positioned and configured to take up the carrier tape separated from the film, a drive connection between said supply spool and said wind-up spool and driving said wind-up spool as said supply spool is driven by drawing off carrier tape, and a tape guide device holding a part of the carrier tape ready as a loop;

wherein at least one seat is formed in said casing configured to hold said interchangeable cassette in a first position with respect to said casing such that said applicator strip enters the carrier tape loop and from which said interchangeable cassette is movable into an end position in said casing pushed back from said applicator strip with the tape loop taut around said applicator strip.

13. Hand-operated appliance according to claim 12, wherein in said first position said tape guide device protrudes with respect to said applicator strip such that said applicator strip enters the carrier tape loop wherein said interchangeable cassette is placed on said at least one seat.

14. Hand-operated appliance according to claim 12, wherein said at least one seat is shaped to guide said interchangeable cassette from said first position into said end position.

15. Hand-operated appliance according to claim 14, wherein said at least one seat includes slopes configured to assist in moving said interchangeable cassette from said first position to said end position.

16. Hand-operated appliance according to claim 12, wherein said casing further comprises locking means configured to secure said interchangeable cassette in said end position.

17. Hand-operated appliance according to claim 16, wherein said at least one seat is formed on said locking means.

18. Hand-operated appliance according to claim 16, wherein said interchangeable cassette further comprises a plate carrying said supply spool and said wind-up spool and in which openings or recesses are formed positioned spaced apart from said spools to engage with said locking means.

19. Hand-operated appliance according to claim 16, wherein:

said casing further comprises a first casing half and a second casing half;

said locking means are provided on said first casing half;

first and second bearing sleeves corresponding, respectively, to said supply spool and said wind-up spool are provided on said second casing half; and said first and second casing halves are joined together with said interchangeable cassette in said end position to form a loaded hand-operated appliance, with said first and second bearing sleeves on said second casing half respectively extending through said supply spool and said wind-up spool to hold said interchangeable cassette in said end position within said casing.

20. Hand-operated appliance according to claim 12, wherein said drive connection is formed by a direct contact between said supply spool and said wind-up spool.

21. Hand-operated appliance according to claim 20, wherein said drive connection further includes a slip coupling.

22. Hand-operated appliance according to claim 12, wherein:

said casing further comprises a first casing half and a second casing half;

said applicator strip and said at least one step are provided on said first casing half;

first and second bearing sleeves corresponding, respectively, to said supply spool and said wind-up spool are provided on said second casing half; and said first and second casing halves are joined together with said interchangeable cassette in said end position to form a loaded hand-operated appliance, with said first and second bearing sleeves on said second casing half respectively extending through said supply spool and said wind-up spool to hold said interchangeable cassette in said end position within said casing.

23. A method of loading an interchangeable cassette carrying a carrier tape coated with a film into a casing, said interchangeable cassette comprising a supply spool carrying the coated carrier tape, a wind-up spool rotatably coupled to said supply spool and positioned to take up the carrier tape separated from the film, and a tape guide device holding a part of the coated carrier tape in a loop, and said casing comprising an applicator strip and at least one seat configured to hold said interchangeable cassette in a first position, said method comprising:

guiding said applicator strip into the tape loop;

inserting said interchangeable cassette onto said at least one seat in said casing; and moving said interchangeable cassette off said at least one seat and away from said applicator strip and into a loaded position in said casing.

24. A method according to claim 23, wherein moving said interchangeable cassette into said loaded position comprises moving said interchangeable cassette into engagement with said casing.

25. A method according to claim 23, wherein said casing comprises a first casing half on which said applicator strip and said at least one seat are provided and a second casing half on which first and second bearing sleeves corresponding, respectively, to said supply spool and said wind-up spool are provided, said method further comprising:

inserting said first and second bearing sleeves into said supply spool and said wind-up spool, respectively, once said interchangeable cassette has been moved into said end position; and coupling said second casing half to said first casing half.

26. A method according to claim 25, wherein locking means are provided on said first casing half spaced from said applicator strip to engage said interchangeable cassette and to hold said interchangeable cassette in said loaded position.

27. A method according to claim 23, wherein:

first and second bearing sleeves are provided in said casing; and moving said interchangeable cassette further comprises moving said interchangeable cassette into engagement with said first and second bearing sleeves.

* * * * *